US011693438B2

(12) United States Patent
Hu

(10) Patent No.: US 11,693,438 B2
(45) Date of Patent: Jul. 4, 2023

(54) VOLTAGE REGULATION CIRCUIT

(71) Applicant: Wistron NeWeb Corporation, Hsinchu (TW)

(72) Inventor: Shao-Chueh Hu, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 83 days.

(21) Appl. No.: 17/406,148

(22) Filed: Aug. 19, 2021

(65) Prior Publication Data

US 2022/0147083 A1 May 12, 2022

(30) Foreign Application Priority Data

Nov. 10, 2020 (TW) ..... 109139225

(51) Int. Cl.
*G05F 1/575* (2006.01)
*G05F 1/565* (2006.01)
*G05F 1/567* (2006.01)

(52) U.S. Cl.
CPC ..... *G05F 1/575* (2013.01); *G05F 1/567* (2013.01)

(58) Field of Classification Search
CPC ..... G05F 1/575; G05F 1/567
See application file for complete search history.

(56) References Cited

U.S. PATENT DOCUMENTS

2009/0230934 A1* 9/2009 Hooijschuur ..... H02M 3/07 323/351
2011/0109291 A1* 5/2011 Tang ..... H02M 3/156 323/282
2014/0139196 A1* 5/2014 Chen ..... H02M 3/156 323/271
2019/0319540 A1* 10/2019 Arno ..... H02M 1/0025
2019/0386565 A1* 12/2019 Rosolowski ..... H02M 3/1584
2020/0310477 A1* 10/2020 Kim ..... G05F 1/565
2021/0408969 A1* 12/2021 Bang ..... H03F 3/245
2022/0075401 A1* 3/2022 Lee ..... H02M 1/007

FOREIGN PATENT DOCUMENTS

EP 3557742 B1 * 12/2020 ..... H02M 3/156
KR 20220130400 A * 9/2022
TW M595361 U 5/2020

OTHER PUBLICATIONS

English translation of TWM595361, Jin N, voltage reguator system (Year: 2020).*

* cited by examiner

*Primary Examiner* — Sisay G Tiku
(74) *Attorney, Agent, or Firm* — McClure, Qualey & Rodack, LLP

(57) ABSTRACT

A voltage regulation circuit includes a node, a voltage regulator, a plurality of load units and a voltage feedback circuit. The node has a node voltage. The voltage regulator is electrically connected to the node. The load units are electrically connected to the voltage regulator via the node. The load units are driven by the node voltage and have at least one load state. The voltage feedback circuit is electrically connected between the voltage regulator and the node. The voltage feedback circuit includes a switch and receives the node voltage and a control signal. The control signal includes the at least one load state. The voltage feedback circuit controls the switch according to the at least one load state of the control signal to output a feedback voltage. The voltage regulator adjusts the node voltage according to the feedback voltage.

12 Claims, 10 Drawing Sheets

100

430

400

VOLTAGE REGULATION CIRCUIT

RELATED APPLICATIONS

This application claims priority to Taiwan Application Serial Number 109139225, filed Nov. 10, 2020, which is herein incorporated by reference.

BACKGROUND

Technical Field

The present disclosure relates to a voltage regulation circuit. More particularly, the present disclosure relates to a voltage regulation circuit with a feedback voltage.

Description of Related Art

For the requirements of the power supply in today's systems, various types of voltage regulators have been proposed to meet the power saving, low voltage, complex current requirements of blocks of a chip and an upper limit value and a lower limit value of an input voltage specification of the chip. The types of voltage regulators include a dynamic voltage scaling (DVS) regulator, a programmable voltage regulator and an adaptive voltage scaling (AVS) regulator. The DVS regulator can handle the requirements of complex dynamic current. However, the DVS regulator has high circuit complexity and is more difficult to plan on the PCB layout. The programmable voltage regulator and the AVS regulator both require a single chip as a monitor to control the voltage regulator. If the chip supplier does not plan the function for the single chip or the function does not meet the chip supplier's plan, it will cause the problem that nothing can be changed (the single chip cannot be added).

The circuit structure may be changed for the voltage regulator that cannot meet the specifications, e.g., adding a DVS regulator which is controlled by a block alone or looking for the chip supplier that can provide a complete solution. However, it will increase circuit planning time, circuit complexity and circuit cost. Therefore, a voltage regulation circuit which is suitable for multiple blocks, low complexity, low cost and capable of meeting the requirements of each block at the same time and dynamically adjusting the node voltage to increase a voltage tolerance range is commercially desirable.

SUMMARY

According to one aspect of the present disclosure, a voltage regulation circuit includes a node, a voltage regulator, a plurality of load units and a voltage feedback circuit. The node has a node voltage. The voltage regulator is electrically connected to the node. The load units are electrically connected to the voltage regulator via the node. The load units are driven by the node voltage and have at least one load state. The voltage feedback circuit is electrically connected between the voltage regulator and the node. The voltage feedback circuit includes a switch and receives the node voltage and a control signal. The control signal includes the at least one load state. The voltage feedback circuit controls the switch according to the at least one load state of the control signal to output a feedback voltage, and the voltage regulator adjusts the node voltage according to the feedback voltage.

According to another aspect of the present disclosure, a voltage regulation circuit includes a plurality of nodes, a voltage regulator, a plurality of load units and a voltage feedback circuit. The nodes have a plurality of node voltages, respectively. The voltage regulator is electrically connected to the nodes. The load units are electrically connected to the voltage regulator via the nodes, respectively. The load units are driven by the node voltages, respectively, and have at least one load state. The voltage feedback circuit is electrically connected between the voltage regulator and each of the nodes. The voltage feedback circuit includes a switch and receives the node voltages and a control signal, and the control signal includes the at least one load state. The voltage feedback circuit controls the switch according to the at least one load state of the control signal to output a feedback voltage, and the voltage regulator adjusts the node voltage according to the feedback voltage.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

It will be understood that when an element (or device) is referred to as be "connected to" another element, it can be directly connected to the other element, or it can be indirectly connected to the other element, that is, intervening elements may be present. In contrast, when an element is referred to as be "directly connected to" another element, there are no intervening elements present. In addition, the terms first, second, third, etc. are used herein to describe various elements or components, these elements or components should not be limited by these terms. Consequently, a first element or component discussed below could be termed a second element or component.

Figure 1:
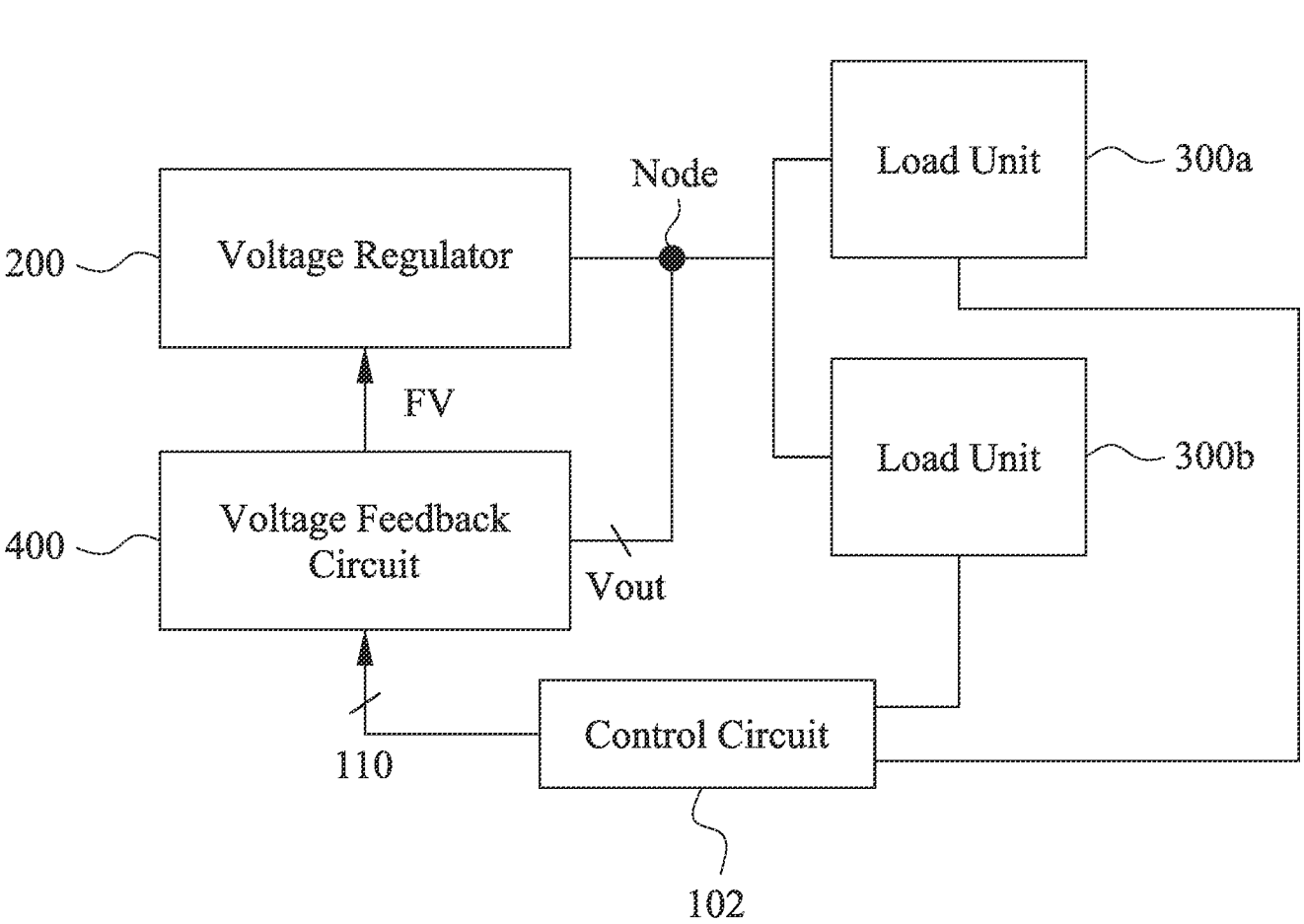
FIG. 1 shows a block diagram of a voltage regulation circuit according to a first embodiment of the present disclosure.

FIG. 1 shows a block diagram of a voltage regulation circuit 100 according to a first embodiment of the present disclosure. The voltage regulation circuit 100 includes a node Node, a voltage regulator 200, a plurality of load units 300*a*, 300*b*, a voltage feedback circuit 400 and a control circuit 102.

The node Node has a node voltage Vout. The voltage regulator 200 is electrically connected to the node Node. The load units 300*a*, 300*b* are electrically connected to the voltage regulator 200 via the node Node. The load units 300*a*, 300*b* are driven by the node voltage Vout and have at least one load state. The voltage feedback circuit 400 is electrically connected between the voltage regulator 200 and the node Node. The voltage feedback circuit 400 includes a switch and receives the node voltage Vout and a control signal 110, and the control signal 110 includes the at least one load state. The voltage feedback circuit 400 controls the switch according to the at least one load state of the control signal 110 to output a feedback voltage FV, and the voltage regulator 200 adjusts the node voltage Vout according to the feedback voltage FV. In addition, the control circuit 102 is connected between the voltage feedback circuit 400 and each of the load units 300*a*, 300*b*. The control circuit 102 is configured to sense the load units 300*a*, 300*b* and generate a control signal 110 corresponding to the load state. The control circuit 102 may include a temperature sensor or a current sensor and can be implemented by a general purpose input output (GPIO) architecture or a master/slave architecture, but the present disclosure is not limited thereto. Therefore, the voltage regulation circuit 100 of the present disclosure monitors at least one power network node (i.e., the node Node) and utilizes the control signal 110 corresponding to the at least one load state and the switch of the voltage feedback circuit 400 to apply the feedback voltage FV to the voltage regulator 200 after switching, thereby dynamically adjusting the node voltage Vout to increase a voltage tolerance range.

Figure 2:
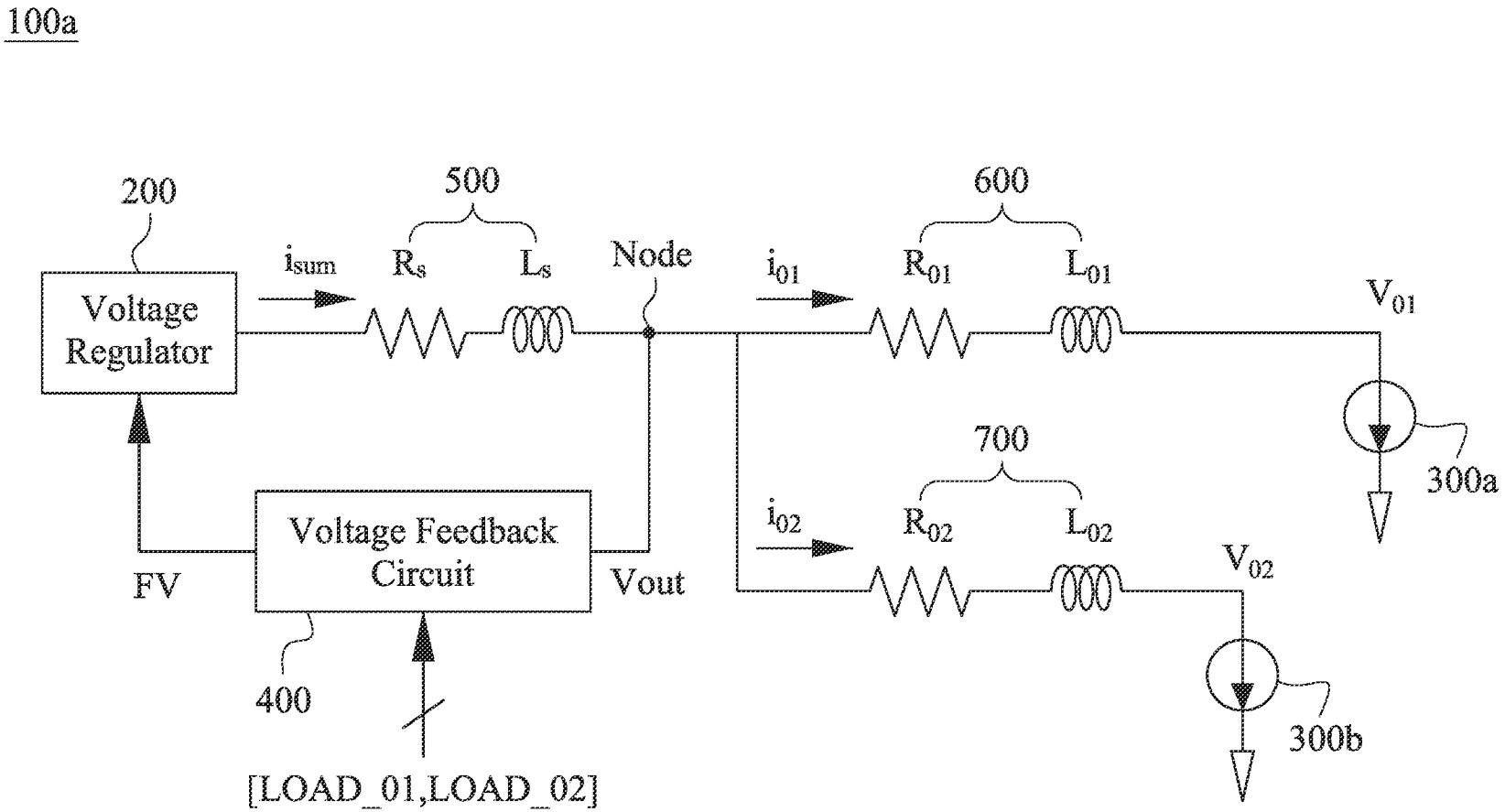
FIG. 2 shows a schematic view of a voltage regulation circuit according to a second embodiment of the present disclosure.
Figure 3:
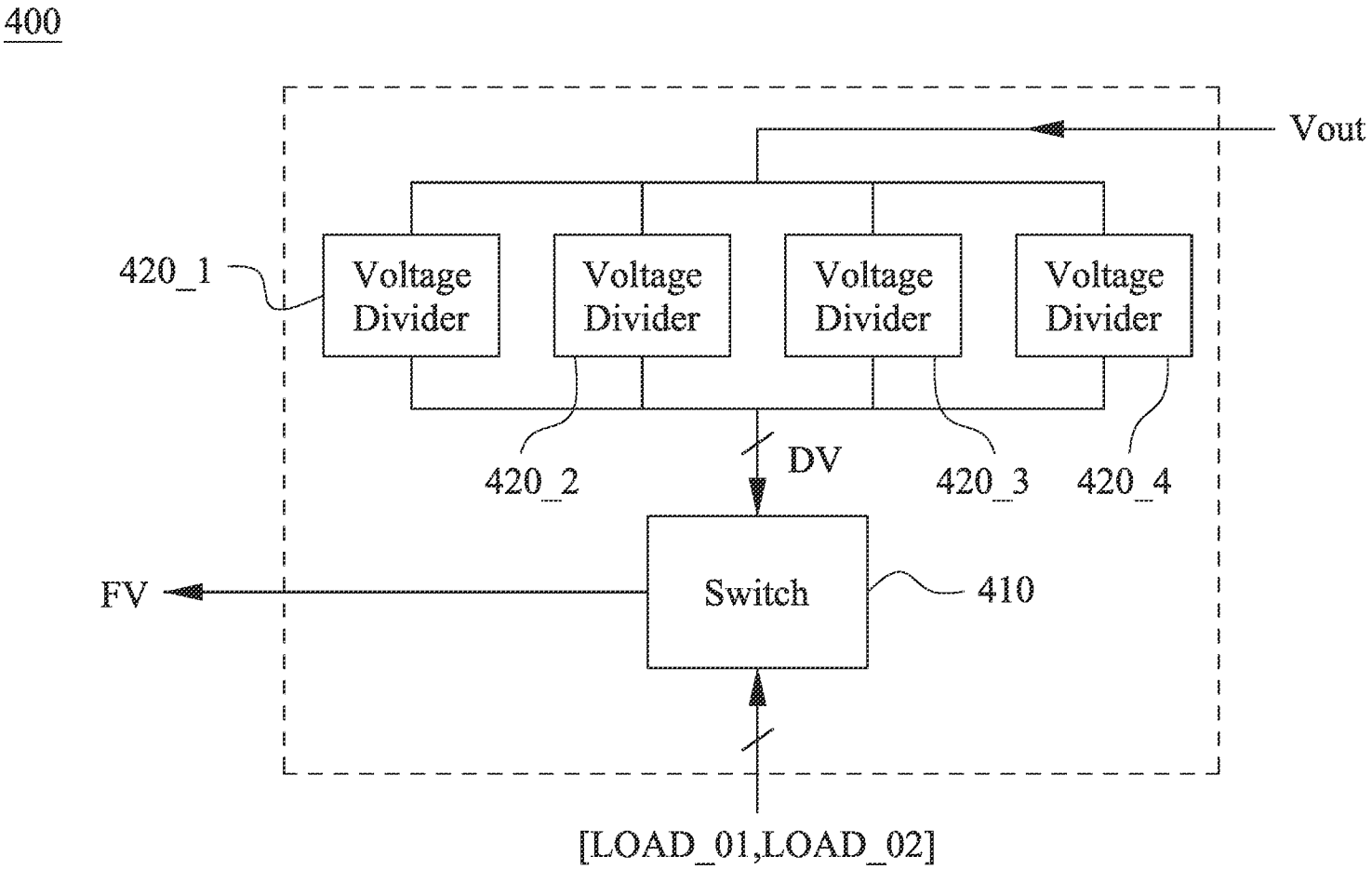
FIG. 3 shows a schematic view of a first example of a voltage feedback circuit of the voltage regulation circuit of FIG. 2.
Figure 4:
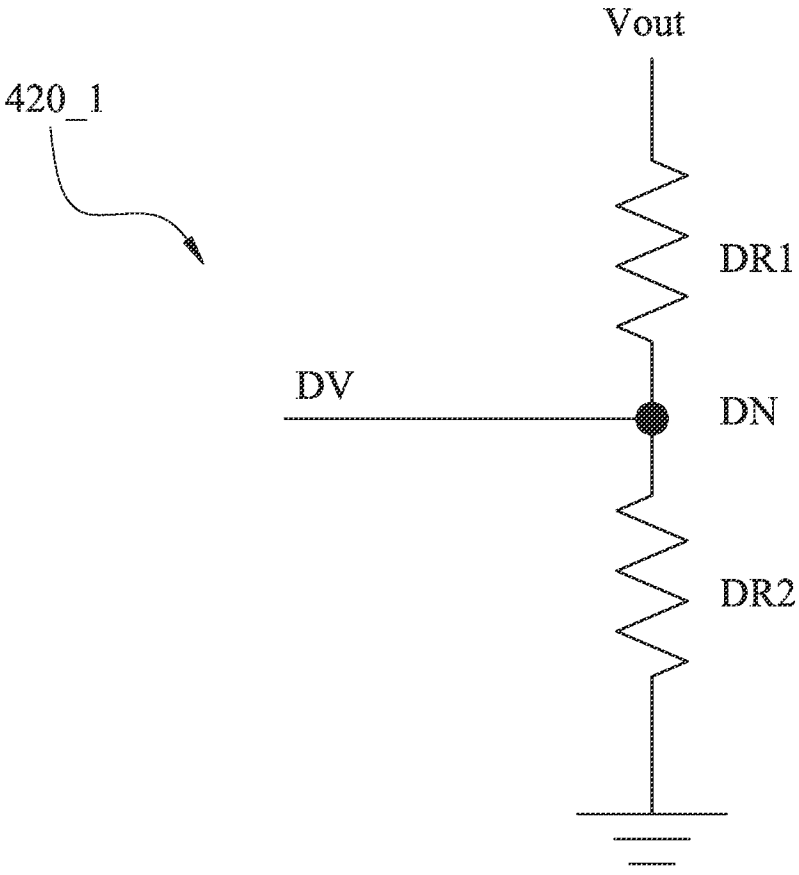
FIG. 4 shows a schematic view of a voltage divider of the voltage feedback circuit of FIG. 3.

Please refer to FIGS. 2, 3 and 4. FIG. 2 shows a schematic view of a voltage regulation circuit 100*a* according to a second embodiment of the present disclosure. FIG. 3 shows a schematic view of a first example of a voltage feedback circuit 400 of the voltage regulation circuit 100*a* of FIG. 2. FIG. 4 shows a schematic view of a voltage divider 420_1 of the voltage feedback circuit 400 of FIG. 3. The voltage regulation circuit 100*a* includes a node Node, a voltage regulator 200, a plurality of load units 300*a*, 300*b*, a voltage feedback circuit 400, a regulating circuit 500, a first circuit 600 and a second circuit 700.

The node Node has a node voltage Vout. The node Node is electrically connected to the voltage feedback circuit 400, the regulating circuit 500, the first circuit 600 and the second circuit 700.

The voltage regulator 200 is electrically connected to the node Node via the regulating circuit 500. The voltage regulator 200 may be a bulk converter, but the present disclosure is not limited thereto. The voltage regulator 200 is regulated by the feedback voltage FV and generates a regulating circuit current $i_{sum}$.

The load units 300*a*, 300*b* are electrically connected to the voltage regulator 200 via the node Node, the regulating circuit 500, the first circuit 600 and the second circuit 700. The load units 300*a*, 300*b* are driven by the node voltage Vout and have at least one load state. In detail, the load units 300*a*, 300*b* include a first load unit 300*a* and a second load unit 300*b*. The first load unit 300*a* is configured to generate a first load current. The first load current is one of a first heavy load current and a first light load current. The first heavy load current is greater than the first light load current. The second load unit 300*b* is configured to generate a second load current. The second load current is one of a second heavy load current and a second light load current. The second heavy load current is greater than the second light load current.

The voltage feedback circuit 400 is electrically connected between the voltage regulator 200 and the node Node. The voltage feedback circuit 400 includes a switch 410 and receives the node voltage Vout and a control signal, and the control signal includes the at least one load state. The voltage feedback circuit 400 controls the switch 410 according to the at least one load state of the control signal to output a feedback voltage FV, and the voltage regulator 200 adjusts the node voltage Vout according to the feedback voltage FV. The at least one load state is corresponding to at least one current of the load units 300*a*, 300*b*. In detail, the voltage feedback circuit 400 includes the switch 410 and four voltage dividers 420_1, 420_2, 420_3, 420_4. The switch 410 is an N-to-1 switch. The number of the at least one load state of the load units 300*a*, 300*b* is plural, and N is corresponding to the number of the load states of the load units 300*a*, 300*b*. For example, in FIG. 3, N is equal to four. The number of the load states of the load units 300*a*, 300*b* is equal to four, and the load states of the load units 300*a*, 300*b* are corresponding to the one of the first heavy load current and the first light load current and the one of the second heavy load current and the second light load current, which is one of the four load states. The voltage dividers 420_1, 420_2, 420_3, 420_4 are electrically connected between the switch 410 and the node Node. The voltage dividers 420_1, 420_2, 420_3, 420_4 receive the node voltage Vout and convert the node voltage Vout to a plurality of dividing voltages DV, and the voltage dividers 420_1, 420_2, 420_3, 420_4 transmit the dividing voltages DV to the switch 410. The switch 410 is switched to output the feedback voltage FV to be one of the dividing voltages DV according to the load states of the control signal. The control signal includes a first load state LOAD_01 and a second load state LOAD_02. The first load state LOAD_01 is corresponding to the first load current of the first load unit 300*a*. In response to determining that the first load state LOAD_01 is 1, the first load current is the first heavy load current. In response to determining that the first load state LOAD_01 is 0, the first load current is the first light load current. The second load state LOAD_02 is corresponding to the second load current of the second load unit 300*b*. In response to determining that the second load state LOAD_02 is 1, the second load current is the second heavy load current. In response to determining that the second load state LOAD_02 is 0, the second load current is the second light load current. For example, when [LOAD_01,LOAD_02] is equal to [1,1], the switch 410 outputs the dividing voltage DV of the voltage divider 420_1. When [LOAD_01, LOAD_02] is equal to [0,1], the switch 410 outputs the dividing voltage DV of the voltage divider 420_2. When [LOAD_01,LOAD_02] is equal to [0,0], the switch 410 outputs the dividing voltage DV of the voltage divider 420_3. When [LOAD_01,LOAD_02] is equal to [1,0], the switch 410 outputs the dividing voltage DV of the voltage divider 420_4.

The voltage divider 420_1 includes a first voltage dividing resistor DR1 and a second voltage dividing resistor DR2, and the first voltage dividing resistor DR1 is electrically connected to the second voltage dividing resistor DR2 via an internal node DN. When the node voltage Vout is inputted to the first voltage dividing resistor DR1, the internal node DN generates the dividing voltage DV according to voltage division of the first voltage dividing resistor DR1 and the second voltage dividing resistor DR2. For example, the first voltage dividing resistor DR1 and the second voltage dividing resistor DR2 are both equal to 10K ohms. The node voltage Vout is 1.2 V, and the dividing voltage DV is 0.6 V. The structure of the voltage dividers 420_2, 420_3, 420_4 is similar to the structure of the voltage divider 420_1, and will not be described again herein.

The regulating circuit 500 includes a regulating resistor $R_s$ and a regulating inductor $L_s$, and the regulating resistor $R_s$ is electrically connected to the regulating inductor $L_s$. The regulating circuit 500 is electrically connected between the voltage regulator 200 and the node Node. A regulating circuit current $i_{sum}$ flows through the regulating circuit 500.

The first circuit 600 includes a first resistor $R_{01}$ and a first inductor $L_{01}$, and the first resistor $R_{01}$ is electrically connected to the first inductor $L_{01}$. The first circuit 600 is electrically connected between the first load unit 300*a* and the node Node. A first circuit current $i_{01}$ flows through the first circuit 600 and the first load unit 300*a*.

The second circuit 700 includes a second resistor $R_{02}$ and a second inductor $L_{02}$, and the second resistor $R_{02}$ is electrically connected to the second inductor $L_{02}$. The second circuit 700 is electrically connected between the second load unit 300*b* and the node Node. A second circuit current $i_{02}$ flows through the second circuit 700 and the second load unit 300*b*.

Figure 5:
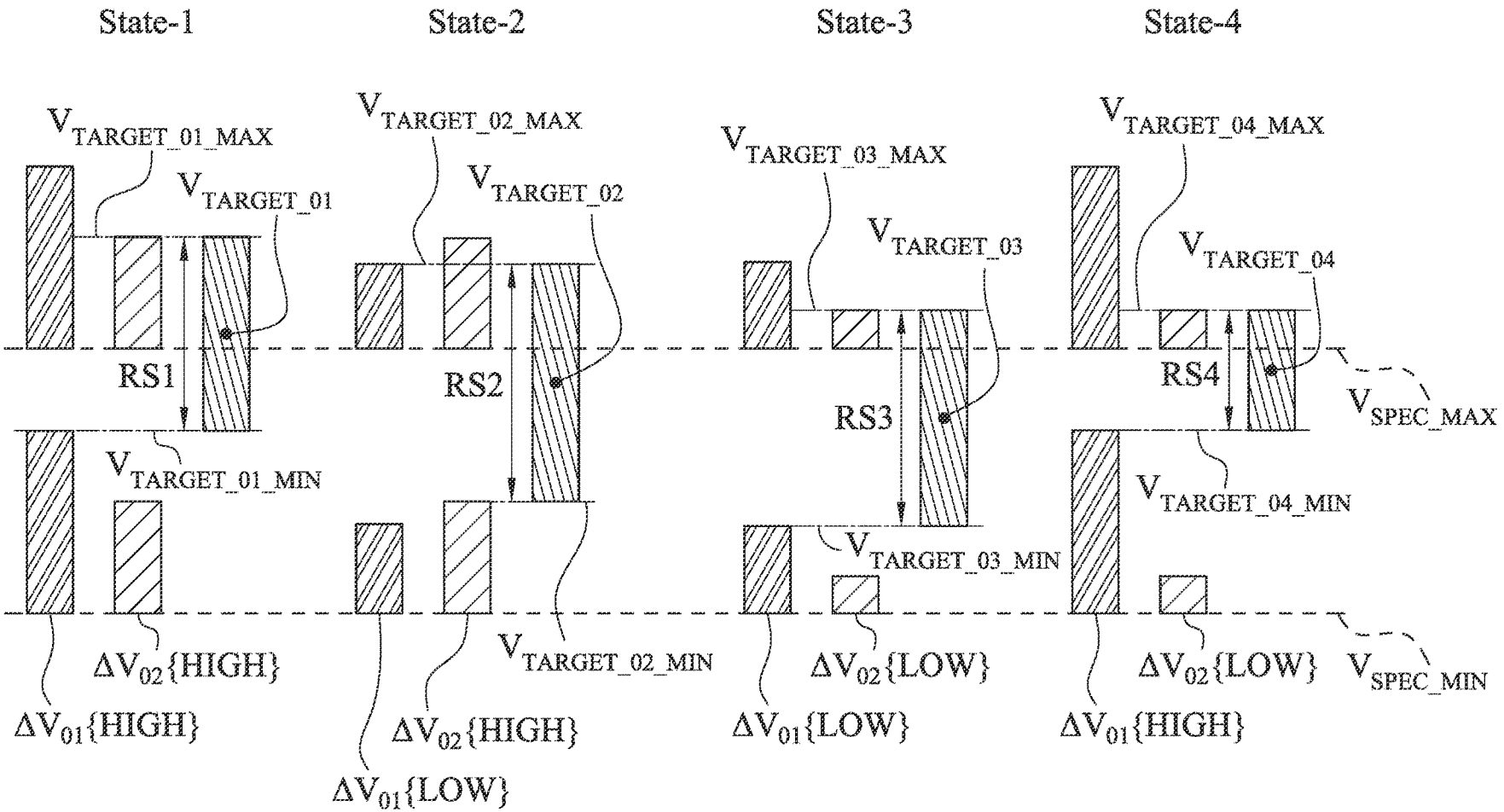
FIG. 5 shows a schematic view of four setting ranges of four target voltage values of four states of FIG. 2.

Please refer to FIGS. 2, 3 and 5. FIG. 5 shows a schematic view of four setting ranges RS1, RS2, RS3, RS4 of four target voltage values $V_{TARGET_01}$, $V_{TARGET_02}$, $V_{TARGET_03}$, $V_{TARGET_04}$ of four states of FIG. 2. The voltage regulation circuit 100*a* is a dynamic voltage scaling (DVS) regulator. The node Node is electrically connected to the voltage regulator 200 via the voltage dividers 420_1, 420_2, 420_3, 420_4 of the voltage feedback circuit 400, so that no matter what the load current is, the node voltage Vout can be controlled at a target voltage value $V_{TARGET}$. The target voltage value $V_{TARGET}$ is an optimal setting value of the node voltage Vout. A plurality of voltages $V_{01}$, $V_{02}$ of the load units 300*a*, 300*b* conform to an input voltage specification of the semiconductor integrated circuit (IC) and are described as follows:

$$V_{SPEC_MIN} \le V_{01}, V_{02} \le V_{SPEC_MAX} \quad (1).$$

$$V_{01} = V_{TARGET} - \Delta V_{01} \quad (2).$$

$$V_{SPEC_MIN} \le V_{TARGET} - \Delta V_{01}\{\text{HIGH, LOW}\} \le V_{SPEC_MAX} \quad (3).$$

$$V_{TARGET} \le V_{SPEC_MAX} + \Delta V_{01}\{\text{HIGH,LOW}\} \quad (4).$$

$$V_{SPEC_MIN} + \Delta V_{01}\{\text{HIGH,LOW}\} \le V_{TARGET} \quad (5).$$

$$V_{02} = V_{TARGET} - \Delta V_{02} \quad (6).$$

$$V_{SPEC_MIN} \le V_{TARGET} - \Delta V_{02}\{\text{HIGH, LOW}\} \le V_{SPEC_MAX} \quad (7).$$

$$V_{TARGET} \le V_{SPEC_MAX} + \Delta V_{02}\{\text{HIGH,LOW}\} \quad (8).$$

$$V_{SPEC_MIN} + \Delta V_{02}\{\text{HIGH,LOW}\} \le V_{TARGET} \quad (9).$$

"$V_{SPEC_MAX}$" and "$V_{SPEC_MIN}$" represent an upper limit value and a lower limit value of the input voltage specification, respectively. "$\Delta V_{01}$" and "$\Delta V_{02}$" represent a voltage drop of the first circuit 600 and a voltage drop of the second circuit 700, respectively. "HIGH" represents that the load unit is operated at a heavy load current, and "LOW" represents that the load unit is operated at a light load current. The target voltage value $V_{TARGET}$ needs to satisfy equations (4), (5), (8) and (9) at the same time so as to meet the following equations (10) and (11):

$$V_{TARGET} \le V_{SPEC_MAX} + \text{MIN}(\Delta V_{01}\{\text{HIGH,LOW}\}, \Delta V_{02}\{\text{HIGH,LOW}\}) \quad (10).$$

$$V_{SPEC_MIN} + \text{MAX}(\Delta V_{01}\{\text{HIGH,LOW}\}, \Delta V_{02}\{\text{HIGH, LOW}\}) \le V_{TARGET} \quad (11).$$

Under the condition that the circuit characteristics need to meet equations (10) and (11), an upper limit value and a lower limit value of the target voltage value $V_{TARGET}$ need to meet the following equations (12) and (13):

$$V_{TARGET_MAX} = V_{SPEC_MAX} + \text{MIN}(\Delta V_{01}\{\text{HIGH,LOW}\}, \Delta V_{02}\{\text{HIGH,LOW}\}) \quad (12).$$

$$V_{TARGET_MIN} = V_{SPEC_MIN} + \text{MAX}(\Delta V_{01}\{\text{HIGH,LOW}\}, \Delta V_{02}\{\text{HIGH,LOW}\}) \quad (13).$$

"$V_{TARGET_MAX}$" and "$V_{TARGET_MIN}$" represent the upper limit value and the lower limit value of the target voltage value $V_{TARGET}$, respectively. "MIN($\Delta V_{01}$\{HIGH,LOW\}, $\Delta V_{02}$\{HIGH,LOW\})" represents the smallest one of $\Delta V_{01}$\{HIGH,LOW\} and $\Delta V_{02}$\{HIGH,LOW\}, and "MAX ($\Delta V_{01}$\{HIGH,LOW\}, $\Delta V_{02}$\{HIGH,LOW\})" represents the largest one of $\Delta V_{01}$\{HIGH,LOW\} and $\Delta V_{02}$\{HIGH,LOW\}.

In a first state State-1 of FIG. 5, the first load state LOAD_01 and the second load state LOAD_02 are both 1 (i.e., [LOAD_01,LOAD_02]=[1,1]). The dividing voltage DV generated by the voltage divider 420_1 is transmitted to the switch 410. The switch 410 is switched to output the feedback voltage FV to be the dividing voltage DV generated by the voltage divider 420_1 according to the first state State-1. The setting range RS1 of the target voltage value $V_{TARGET_01}$ of the first state State-1 meets the following equations (14)-(16):

$$V_{TARGET_01_MAX} = V_{SPEC_MAX} + \text{MIN}(\Delta V_{01}\{\text{HIGH}\}, \Delta V_{02}\{\text{HIGH}\}) = V_{SPEC_MAX} + \Delta V_{02}\{\text{HIGH}\} \quad (14).$$

$$V_{TARGET_01_MIN} = V_{SPEC_MIN} + \text{MAX}(\Delta V_{01}\{\text{HIGH}\}, \Delta V_{02}\{\text{HIGH}\}) = V_{SPEC_MIN} + \Delta V_{01}\{\text{HIGH}\} \quad (15).$$

$$V_{TARGET_01} = \text{AVG}\{V_{TARGET_01_MAX}, V_{TARGET_01_MIN}\} \quad (16).$$

In a second state State-2 of FIG. 5, the first load state LOAD_01 and the second load state LOAD_02 are 0 and 1, respectively (i.e., [LOAD_01,LOAD_02]=[0,1]). The dividing voltage DV generated by the voltage divider 420_2 is transmitted to the switch 410. The switch 410 is switched to output the feedback voltage FV to be the dividing voltage DV generated by the voltage divider 420_2 according to the second state State-2. The setting range RS2 of the target voltage value $V_{TARGET_02}$ of the second state State-2 meets the following equations (17)-(19):

$$V_{TARGET_02_MAX} = V_{SPEC_MAX} + \text{MIN}(\Delta V_{01}\{\text{LOW}\}, \Delta V_{02}\{\text{HIGH}\}) = V_{SPEC_MAX} + \Delta V_{01}\{\text{LOW}\} \quad (17).$$

$$V_{TARGET_02_MIN} = V_{SPEC_MIN} + \text{MAX}(\Delta V_{01}\{\text{LOW}\}, \Delta V_{02}\{\text{HIGH}\}) = V_{SPEC_MIN} + \Delta V_{02}\{\text{HIGH}\} \quad (18).$$

$$V_{TARGET_02} = \text{AVG}\{V_{TARGET_02_MAX}, V_{TARGET_02_MIN}\} \quad (19).$$

In a third state State-3 of FIG. 5, the first load state LOAD_01 and the second load state LOAD_02 are both 0 (i.e., [LOAD_01,LOAD_02]=[0,0]). The dividing voltage DV generated by the voltage divider 420_3 is transmitted to the switch 410. The switch 410 is switched to output the feedback voltage FV to be the dividing voltage DV generated by the voltage divider 420_3 according to the third state State-3. The setting range RS3 of the target voltage value $V_{TARGET_03}$ of the third state State-3 meets the following equations (20)-(22):

$$V_{TARGET_03_MAX}=V_{SPEC_MAX}+\mathrm{MIN}(\Delta V_{01}\{\mathrm{LOW}\},\Delta V_{02}\{\mathrm{LOW}\})=V_{SPEC_MAX}+\Delta V_{02}\{\mathrm{LOW}\} \quad (20).$$

$$V_{TARGET_03_MIN}=V_{SPEC_MIN}+\mathrm{MAX}(\Delta V_{01}\{\mathrm{LOW}\},\Delta V_{02}\{\mathrm{LOW}\})=V_{SPEC_MIN}+\Delta V_{01}\{\mathrm{LOW}\} \quad (21).$$

$$V_{TARGET_03}=\mathrm{AVG}\{V_{TARGET_03_MAX},V_{TARGET_03_MIN}\} \quad (22).$$

In a fourth state State-4 of FIG. 5, the first load state LOAD_01 and the second load state LOAD_02 are 1 and 0, respectively (i.e., [LOAD_01,LOAD_02][1,0]). The dividing voltage DV generated by the voltage divider 420_4 is transmitted to the switch 410. The switch 410 is switched to output the feedback voltage FV to be the dividing voltage DV generated by the voltage divider 420_4 according to the fourth state State-4. The setting range RS4 of the target voltage value $V_{TARGET_04}$ of the fourth state State-4 meets the following equations (23)-(25):

$$V_{TARGET_04_MAX}=V_{SPEC_MAX}+\mathrm{MIN}(\Delta V_{01}\{\mathrm{HIGH}\},\Delta V_{02}\{\mathrm{LOW}\})=V_{SPEC_MAX}+\Delta V_{02}\{\mathrm{LOW}\} \quad (23).$$

$$V_{TARGET_04_MIN}=V_{SPEC_MIN}+\mathrm{MAX}(\Delta V_{01}\{\mathrm{HIGH}\},\Delta V_{02}\{\mathrm{LOW}\})=V_{SPEC_MIN}+\Delta V_{01}\{\mathrm{HIGH}\} \quad (24).$$

$$V_{TARGET_04}=\mathrm{AVG}\{V_{TARGET_04_MAX},V_{TARGET_04_MIN}\} \quad (25).$$

"AVG" represents an averaging operation. From the above equations (14)-(25), it can be seen that the voltage regulator 200 and the voltage feedback circuit 400 are configured to determine target upper limit values $V_{TARGET_01_MAX}$, $V_{TARGET_02_MAX}$, $V_{TARGET_03_MAX}$, $V_{TARGET_04_MAX}$ and target lower limit values $V_{TARGET_01_MIN}$, $V_{TARGET_02_MIN}$, $V_{TARGET_03_MIN}$, $V_{TARGET_04_MIN}$ of the node Node according to the load states (i.e., the first load state LOAD_01 and the second load state LOAD_02) of the load units 300*a*, 300*b* to form target voltage values $V_{TARGET_01}$, $V_{TARGET_o2}$, $V_{TARGET_03}$, $V_{TARGET_04}$. The target voltage value $V_{TARGET_01}$ is equal to an intermediate value between the target upper limit value $V_{TARGET_01_MAX}$ and the target lower limit value $V_{TARGET_01_MIN}$. The target voltage value $V_{TARGET_02}$ is equal to an intermediate value between the target upper limit value $V_{TARGET_02_MAX}$ and the target lower limit value $V_{TARGET_02_MIN}$. The target voltage value $V_{TARGET_03}$ is equal to an intermediate value between the target upper limit value $V_{TARGET_03_MAX}$ and the target lower limit value $V_{TARGET_03_MIN}$. The target voltage value $V_{TARGET_04}$ is equal to an intermediate value between the target upper limit value $V_{TARGET_04_MAX}$ and the target lower limit value $V_{TARGET_04_MIN}$.

In the first state State-1, the feedback voltage FV is corresponding to the target voltage value $V_{TARGET_01}$, and the voltage regulator 200 adjusts the node voltage Vout toward the target voltage value $V_{TARGET_01}$ according to the feedback voltage FV. In the second state State-2, the feedback voltage FV is corresponding to the target voltage value $V_{TARGET_02}$, and the voltage regulator 200 adjusts the node voltage Vout toward the target voltage value $V_{TARGET_02}$ according to the feedback voltage FV. In the third state State-3, the feedback voltage FV is corresponding to the target voltage value $V_{TARGET_03}$, and the voltage regulator 200 adjusts the node voltage Vout toward the target voltage value $V_{TARGET_03}$ according to the feedback voltage FV. In the fourth state State-4, the feedback voltage FV is corresponding to the target voltage value $V_{TARGET_04}$, and the voltage regulator 200 adjusts the node voltage Vout toward the target voltage value $V_{TARGET_04}$ according to the feedback voltage FV. Therefore, the main concept of the present disclosure is to use the switch 410 of the voltage feedback circuit 400 to divide the target voltage value $V_{TARGET}$ that was originally considered to meet the equations (4), (5), (8), (9) into several states, thereby dynamically switching the feedback voltage FV to meet the requirements of complex dynamic currents.

In addition, the dynamic currents $i_{01}$\{HIGH,LOW\}, $i_{02}$\{HIGH,LOW\} of the load units 300*a*, 300*b* of FIG. 2 can define four states which are [$i_{01}$_HIGH,$i_{02}$_LOW], [$i_{01}$_LOW,$i_{02}$_HIGH] and [$i_{01}$_LOW,$i_{02}$_LOW]. The four states can be represented by current magnitudes of the first load state LOAD_01 and the second load state LOAD_02. The first load state LOAD_01 and the second load state LOAD_02 control the switch 410 of the voltage feedback circuit 400 to dynamically adjust the setting value of the node voltage Vout.

Accordingly, the voltage regulation circuit 100*a* of the present disclosure utilizes the node voltage Vout of the single node Node, the control signal corresponding to the load states and the switch 410 of the voltage feedback circuit 400 to apply the feedback voltage FV to the voltage regulator 200 after switching, thereby dynamically adjusting the node voltage Vout to increase the voltage tolerance range and allowing a system on a chip (SaC) to provide an increased noise margin against voltage ripple noise.

Figure 6:
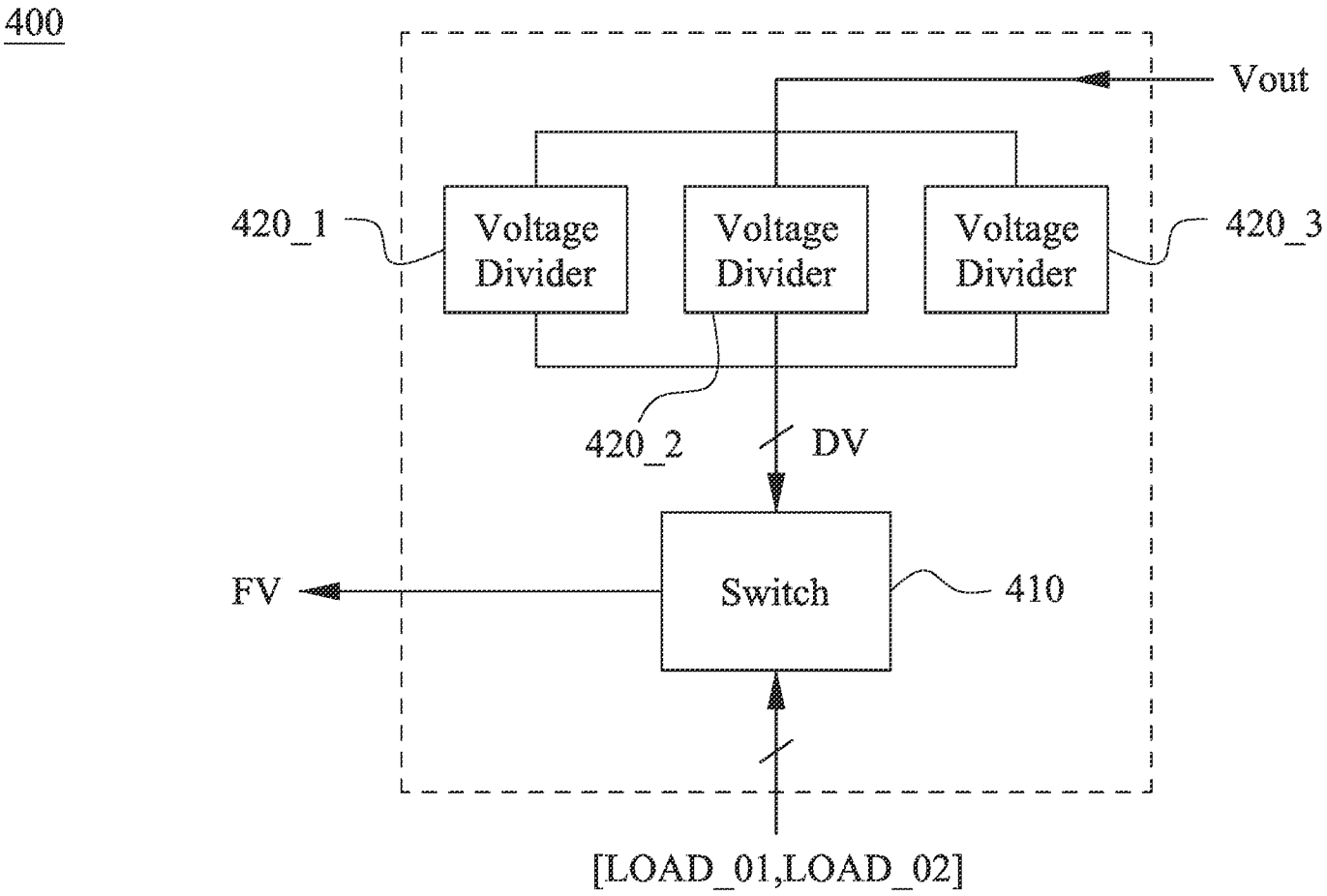
FIG. 6 shows a schematic view of a second example of a voltage feedback circuit of the voltage regulation circuit of FIG. 2.

Please refer to FIGS. 2, 3 and 6. FIG. 6 shows a schematic view of a second example of a voltage feedback circuit 400 of the voltage regulation circuit 100*a* of FIG. 2. The voltage feedback circuit 400 includes a switch 410 and three voltage dividers 420_1, 420_2, 420_3. The switch 410 is a 3-to-1 switch, and the three voltage dividers 420_1, 420_2, 420_3 are the same as the three voltage dividers 420_1, 420_2, 420_3 of FIG. 3, respectively. The difference between the second example of the voltage feedback circuit 400 of FIG. 6 and the first example of the voltage feedback circuit 400 of FIG. 3 is that the second example of the voltage feedback circuit 400 of FIG. 6 can share the voltage divider (e.g., the second state State-2 and the fourth state State-4 share the voltage divider 420_2) to simplify the complexity of the circuit. The sharing can be adjusted according to requirements, and the present disclosure is not limited thereto.

In FIG. 2, the load units 300*a*, 300*b* can be a radio frequency transmitting circuit (TX) and a radio frequency receiving circuit (RX), respectively. The radio frequency transmitting circuit generates a transmitting current. The radio frequency receiving circuit generates a receiving current. The load state of the load units 300*a*, 300*b* is corresponding to one of the transmitting current and the receiving current, so that the switch 410 is switched to output the feedback voltage FV according to the one of the transmitting current and the receiving current. In detail, the control circuit 102 in FIG. 1 can receive the transmitting current and the receiving current of the load units 300*a*, 300*b*, and then generate a transmitting load state TX_ENABLE. The transmitting current is greater than the receiving current. The load state can be the transmitting current of the radio frequency transmitting circuit (corresponding to the transmitting load state TX_ENABLE). In other words, when the transmitting load state TX_ENABLE corresponding to the transmitting current is 0, it is equivalent that the first load state LOAD_01 and the second load state LOAD_02 are 0 and 1, respectively (i.e., [LOAD_01,LOAD_02]=[0,1]). When the transmitting load state TX_ENABLE corresponding to the transmitting current is 1, it is equivalent that the first load state LOAD_01 and the second load state LOAD_02 are 1 and 0, respectively (i.e., [LOAD_01,LOAD_02]=[1,0]). Therefore, the present disclosure can not only dynamically adjust the node voltage Vout, but also reduce the hardware complexity of the voltage feedback circuit 400 via the transmitting load state TX_ENABLE corresponding to the transmitting current of the radio frequency transmitting circuit and the simple switch 410 (e.g., a 2-to-1 switch).

Figure 7:
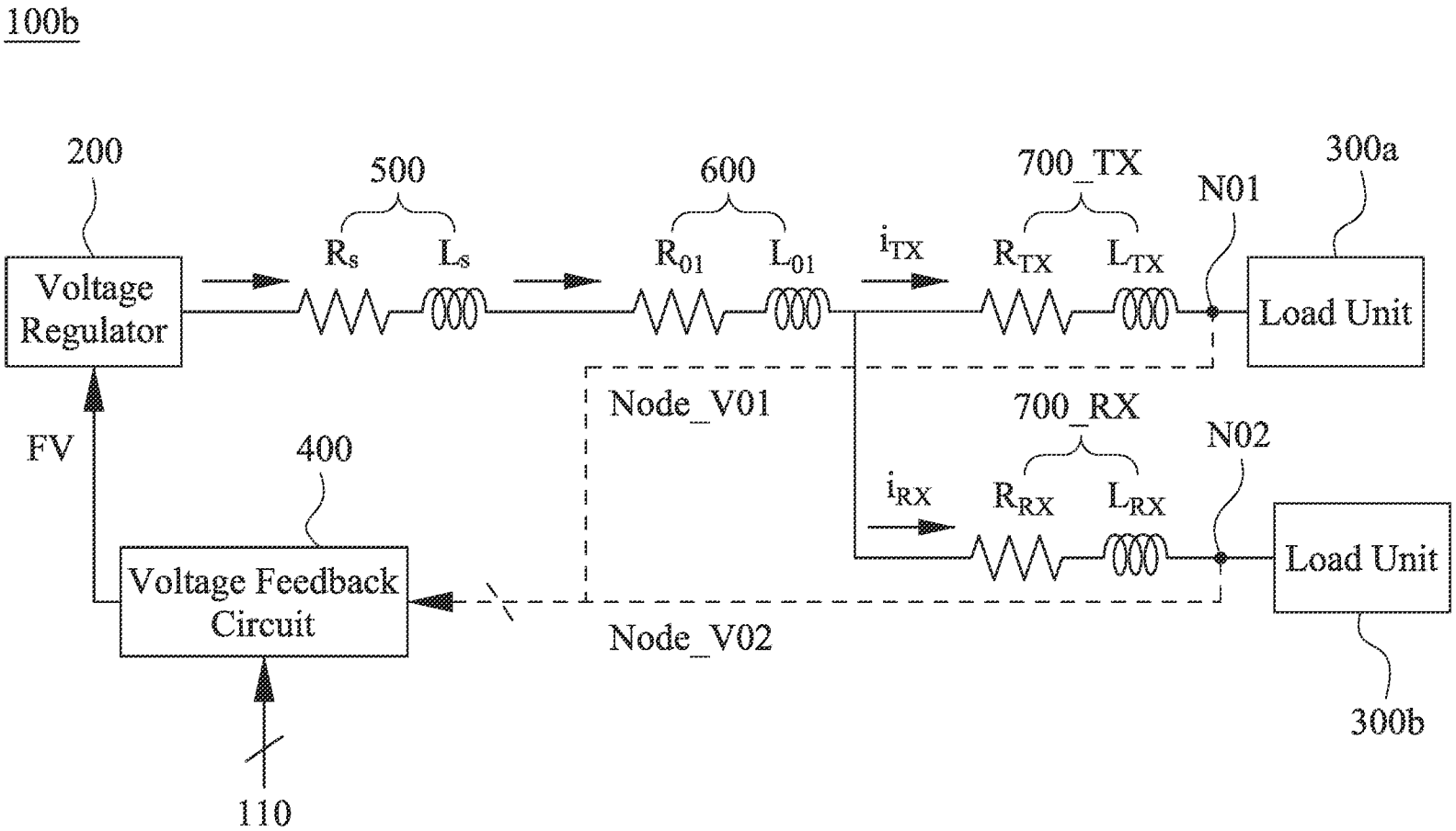
FIG. 7 shows a block diagram of a voltage regulation circuit according to a third embodiment of the present disclosure.
Figure 8:
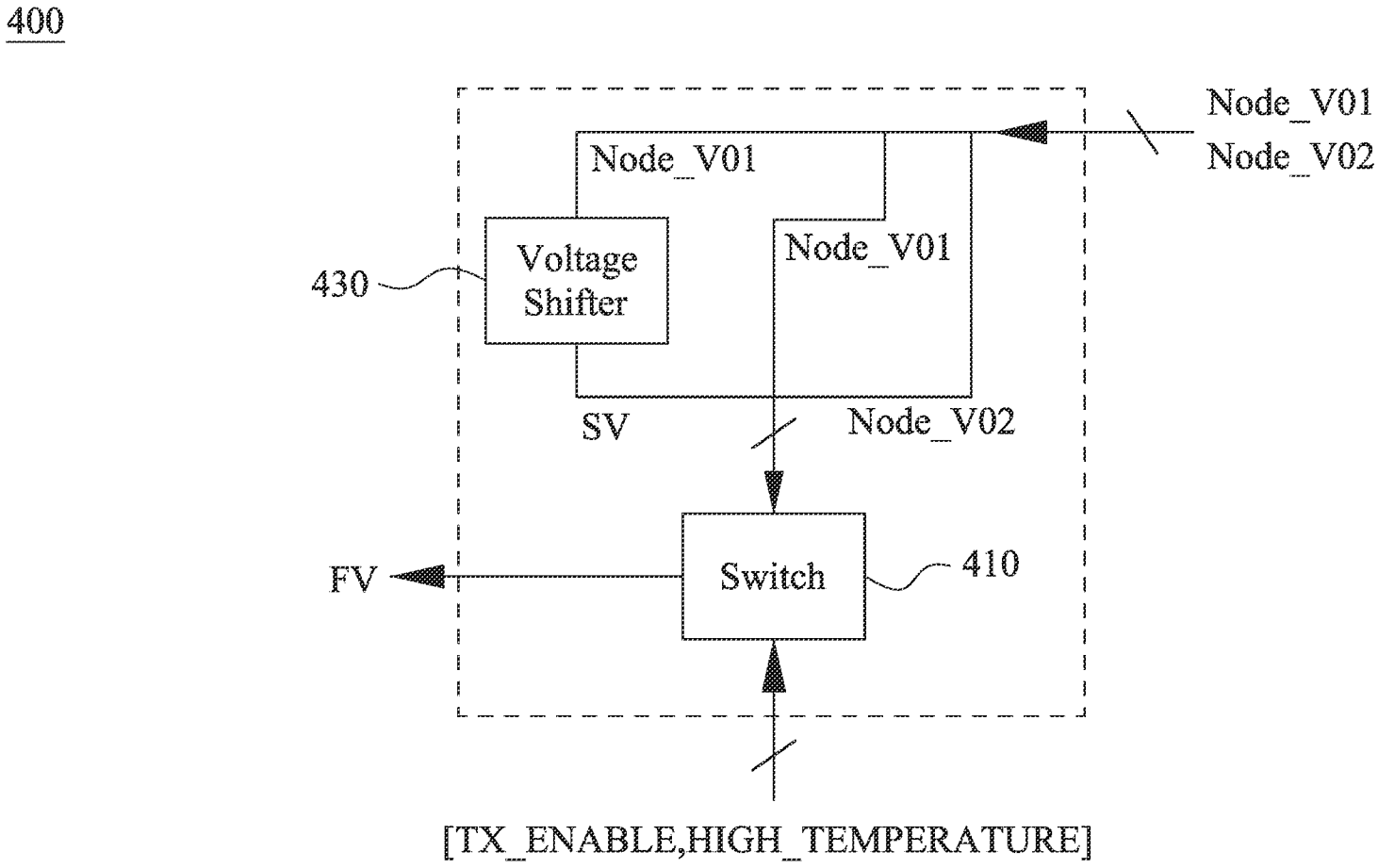
FIG. 8 shows a schematic view of a first example of a voltage feedback circuit of the voltage regulation circuit of FIG. 7.
Figure 9:
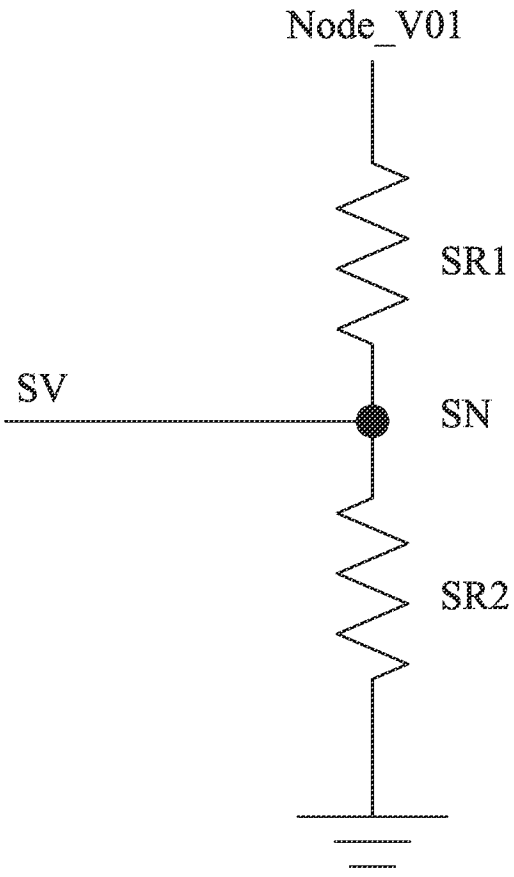
FIG. 9 shows a schematic view of a voltage shifter of the voltage feedback circuit of FIG. 8.

Please refer to FIGS. 7-9. FIG. 7 shows a block diagram of a voltage regulation circuit 100*b* according to a third embodiment of the present disclosure. FIG. 8 shows a schematic view of a first example of a voltage feedback circuit 400 of the voltage regulation circuit 100*b* of FIG. 7. FIG. 9 shows a schematic view of a voltage shifter 430 of the voltage feedback circuit 400 of FIG. 8. The voltage regulation circuit 100*b* includes a plurality of nodes, a voltage regulator 200, a plurality of load units 300*a*, 300*b*, a voltage feedback circuit 400, a regulating circuit 500, a first circuit 600, a transmitting circuit 700_TX and a receiving circuit 700_RX.

The nodes include a transmitting node N01 and a receiving node N02. The transmitting node N01 and the receiving node N02 have a transmitting node voltage Node_V01 and a receiving node voltage Node_V02, respectively. The transmitting node N01 is electrically connected to the load unit 300*a*, the voltage feedback circuit 400 and the transmitting circuit 700_TX. The receiving node N02 is electrically connected to the load unit 300*b*, the voltage feedback circuit 400 and the receiving circuit 700_RX.

The voltage regulator 200, the regulating circuit 500 and the first circuit 600 are the same as the voltage regulator 200, the regulating circuit 500 and the first circuit 600 of FIG. 2, respectively.

The load units 300*a*, 300*b* are electrically connected to the voltage regulator 200 via the nodes (e.g., the transmitting node N01 and the receiving node N02), respectively. The load units 300*a*, 300*b* are driven by the transmitting node voltage Node_V01 and the receiving node voltage Node_V02, respectively, and have at least one load state. In detail, the load units 300*a*, 300*b* are a radio frequency transmitting circuit (TX) and a radio frequency receiving circuit (RX), respectively. The radio frequency transmitting circuit generates a transmitting current. The radio frequency receiving circuit generates a receiving current. The at least one load state of the load units 300*a*, 300*b* is corresponding to one of the transmitting current and the receiving current, so that the switch 410 of the voltage feedback circuit 400 is switched to output the feedback voltage FV according to the one of the transmitting current and the receiving current.

The voltage feedback circuit 400 is electrically connected between the voltage regulator 200 and each of the nodes. The voltage feedback circuit 400 includes a switch 410 and a voltage shifter 430, and receives the transmitting node voltage Node_V01, the receiving node voltage Node_V02 and a control signal 110. The control signal 110 includes the at least one load state. In detail, the switch 410 is an N-to-1 switch. The control signal 110 includes a transmitting load state TX_ENABLE and a temperature state HIGH_TEMPERATURE. The transmitting load state TX_ENABLE is corresponding to the transmitting current of the radio frequency transmitting circuit. The temperature state HIGH_TEMPERATURE is sensed by a temperature sensor. The temperature sensor is electrically connected to the voltage feedback circuit 400. The temperature sensor senses an environmental temperature in an environmental space to obtain the temperature state HIGH_TEMPERATURE, and the load units 300*a*, 300*b* are located in the environmental space. In addition, the voltage shifter 430 is electrically connected between the switch 410 and the transmitting node N01. The voltage shifter 430 receives the transmitting node voltage Node_V01 of the transmitting node N01 and shifts the transmitting node voltage Node_V01 to a shifted voltage SV, and the voltage shifter 430 transmits the shifted voltage SV to the switch 410. The switch 410 is switched to output the feedback voltage FV to be the shifted voltage SV according to the transmitting load state TX_ENABLE and the temperature state HIGH_TEMPERATURE of the control signal 110. In other words, the switch 410 is switched to output the feedback voltage FV to be one of the transmitting node voltage Node_V01, the receiving node voltage Node_V02 and the shifted voltage SV according to the one of the transmitting current and the receiving current. In response to determining that the radio frequency transmitting circuit (e.g., the load unit 300*a*) is turned on and the radio frequency receiving circuit (e.g., the load unit 300*b*) is turned off, the switch 410 is switched to output the feedback voltage FV to be the transmitting node voltage Node_V01 according to the transmitting current. In response to determining that the radio frequency receiving circuit is turned on and the radio frequency transmitting circuit is turned off, the switch 410 is switched to output the feedback voltage FV to be the receiving node voltage Node_V02 according to the receiving current. In response to determining that the radio frequency receiving circuit and the radio frequency transmitting circuit are both turned on, the switch 410 is switched to output the feedback voltage FV to be the transmitting node voltage Node_V01 according to the transmitting current because the transmitting current is greater than the receiving current. In other words, the operation of the switch 410 is mainly based on the transmitting load state TX_ENABLE of the control signal 110.

The voltage shifter 430 includes a first shift resistor SR1 and a second shift resistor SR2. The first shift resistor SR1 is electrically connected to the second shift resistor SR2 via an internal node SN. When the transmitting node voltage Node_V01 is inputted to the first shift resistor SR1, the internal node SN generates the shifted voltage SV according to voltage division of the first shift resistor SR1 and the second shift resistor SR2. In detail, the first shift resistor SR1 is equal to 454 ohms. The second shift resistor SR2 is equal to 10K ohms. The shifted voltage SV is 1.1 V, and the transmitting node voltage Node_V01 is 1.15 V. Therefore, the voltage shifter 430 can shift the transmitting node voltage Node_V01 and compensate for deterioration of the characteristics of the radio frequency transmitting circuit due to high temperature by increasing the transmitting node voltage Node_V01. The radio frequency transmitting circuit is a block that has a large load and is affected by high environmental temperature. The switch 410 may be controlled by the temperature state HIGH_TEMPERATURE. The voltage shifter 430 of the present disclosure combined with the switch 410 (the 3-to-1 switch) can effectively compensate for deterioration due to high temperature. The resistance values of the first shift resistor SR1 and the second shift resistor SR2 can be adjusted according to requirements, and the present disclosure is not limited thereto.

The transmitting circuit 700_TX includes a transmitting resistor $R_{TX}$ and a transmitting inductor $L_{TX}$, and the transmitting resistor $R_{TX}$ is electrically connected to the transmitting inductor $L_{TX}$. The transmitting circuit 700_TX is electrically connected between the first circuit 600 and the load unit 300*a* (e.g., the radio frequency transmitting circuit). A transmitting circuit current $i_{TX}$ flows through the transmitting circuit 700_TX and the load unit 300*a*.

The receiving circuit 700_RX includes a receiving resistor $R_{RX}$ and a receiving inductor $L_{RX}$, and the receiving resistor $R_{RX}$ is electrically connected to the receiving inductor $L_{RX}$. The receiving circuit 700_RX is electrically connected between the first circuit 600 and the load unit 300*b* (e.g., the radio frequency receiving circuit). A receiving circuit current $i_{RX}$ flows through the receiving circuit 700_RX and the load unit 300*b*.

The radio frequency transmitting circuit and the radio frequency receiving circuit are both ICs. The radio frequency transmitting circuit is configured to transmit a radio frequency signal, and the radio frequency receiving circuit configured to receive the radio frequency signal. The radio frequency transmitting circuit and the radio frequency receiving circuit are both separated from the voltage regulator 200 by a distance. A circuit signal passes through the regulating resistor $R_s$ and the regulating inductor $L_s$ from the voltage regulator 200, and then passes through the first resistor $R_{01}$ and a first inductor $L_{01}$ of the first circuit 600 (such as a PCB wiring), and then is branched to a radio frequency transmitting block and a radio frequency receiving block. The radio frequency transmitting block includes the transmitting resistor $R_{TX}$, the transmitting inductor $L_{TX}$ and the radio frequency transmitting circuit. The radio frequency receiving block includes the receiving resistor $R_{RX}$, the receiving inductor $L_{RX}$ and the radio frequency receiving circuit. In general, the load current of the radio frequency transmitting block is larger, and the radio frequency transmitting block is closer to the voltage regulator 200. The radio frequency receiving block is farther from the voltage regulator 200 ($R_{RX}$>>$R_{TX}$ and $L_{RX}$>>$L_{TX}$). In response to determining that the radio frequency transmitting block is turned on and the radio frequency receiving block is turned off, the system is in a radio frequency transmitting state TX_state. The transmitting load state TX_ENABLE of the control signal 110 is 1, and the switch 410 is switched to output the feedback voltage FV to be the transmitting node voltage Node_V01 according to the transmitting load state TX_ENABLE. The transmitting node voltage Node_V01 can work at an IC target voltage (e.g., 1.1 V), and circuit losses in the path ($R_s/L_s$, $R_{01}/L_{01}$, $R_{TX}/L_{TX}$) can be compensated by sensing the transmitting node voltage Node_V01 feedback to the voltage regulator 200. On the contrary, in response to determining that the radio frequency transmitting block is turned off and the radio frequency receiving block is turned on, the system is in a radio frequency receiving state RX_state. The transmitting load state TX_ENABLE of the control signal 110 is 0, and the switch 410 is switched to output the feedback voltage FV to be the receiving node voltage Node_V02 according to the transmitting load state TX_ENABLE. The receiving node voltage Node_V02 can work at the 1C target voltage, and circuit losses in the path ($R_s/L_s$, $R_{01}/L_{01}$, $R_{RX}/L_{RX}$) can be compensated by sensing the receiving node voltage Node_V02 feedback to the voltage regulator 200. Therefore, the present disclosure directly switches to a feedback reference voltage node adjacent to the block according to operating modes of different blocks, so that the voltage regulator 200 directly compensates for the circuit losses in the path. The radio frequency transmitting state TX_state and the radio frequency receiving state RX_state meet the following equations (26) and (27):

$$V_{BULK}-\Delta V_S-\Delta V_{01}-\Delta V_{TX}=\text{Node_}V01=V_{TARGET_01} \quad (26).$$

$$V_{BULK}=\Delta V_S-\Delta V_{01}-\Delta V_{RX}=\text{Node_}V02=V_{TARGET_02} \quad (27).$$

"$V_{BULK}$" represents an output voltage of the voltage regulator 200. "$\Delta V_s$" represents a voltage drop of the regulating circuit 500. "$\Delta V_{01}$" represents a voltage drop of the first circuit 600. "$\Delta V_{TX}$" represents a voltage drop of the transmitting circuit 700_TX. "$\Delta V_{RX}$" represents a voltage drop of the receiving circuit 700_RX. "$V_{TARGET_01}$" and "$V_{TARGET_02}$" represent the target voltage values of the radio frequency transmitting state TX_state and the radio frequency receiving state RX_state, respectively.

Accordingly, the voltage regulation circuit 100*b* of the present disclosure utilizes the node voltages (e.g., the transmitting node voltage Node_V01 and the receiving node voltage Node_V02) of multiple nodes (e.g., the transmitting node N01 and the receiving node N02), the control signal corresponding to the load states and the switch 410 of the voltage feedback circuit 400 to apply the feedback voltage FV to the voltage regulator 200 after switching, thereby dynamically adjusting the node voltages to increase the voltage tolerance range and allowing a SoC to provide an increased noise margin against voltage ripple noise.

Figure 10:
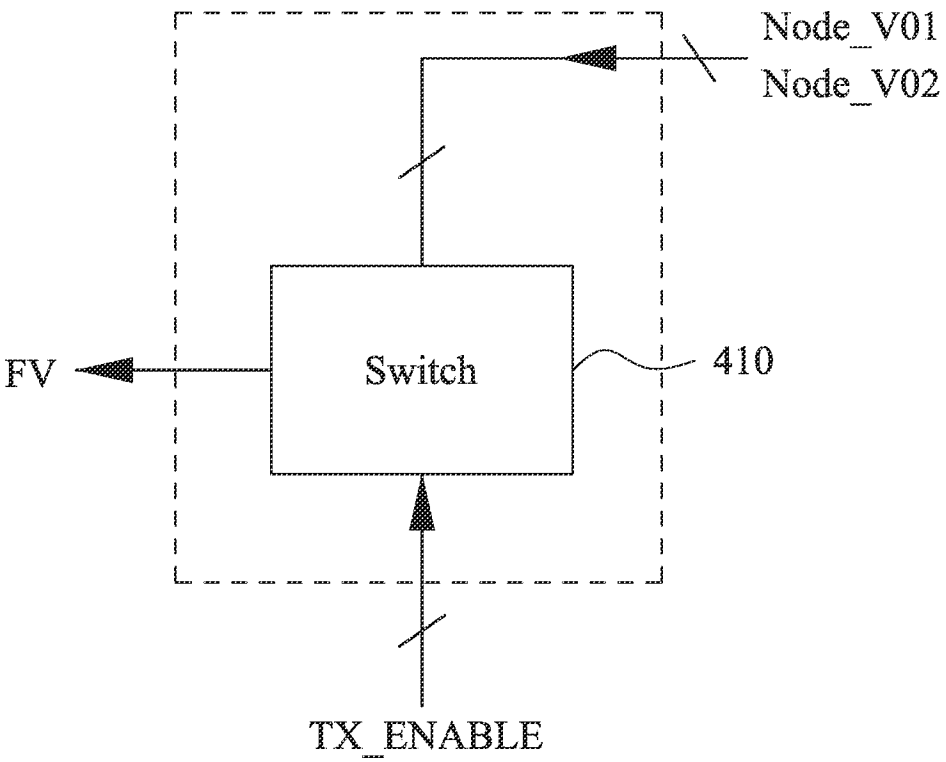
FIG. 10 shows a schematic view of a second example of a voltage feedback circuit of the voltage regulation circuit of FIG. 7.

Please refer to FIGS. 7 and 10. FIG. 10 shows a schematic view of a second example of a voltage feedback circuit 400 of the voltage regulation circuit 100*b* of FIG. 7. The voltage feedback circuit 400 only includes a switch 410. The switch 410 is an N-to-1 switch, and N is equal to two. The control signal 110 only includes a transmitting load state TX_ENABLE. The switch 410 is switched to output the feedback voltage FV to be one of the transmitting node voltage Node_V01 and the receiving node voltage Node_V02 according to the transmitting load state TX_ENABLE of the control signal 110. When the transmitting load state TX_ENABLE is 1, the feedback voltage FV is equal to the transmitting node voltage Node_V01. When the transmitting load state TX_ENABLE is 0, the feedback voltage FV is equal to the receiving node voltage Node_V02.

According to the aforementioned embodiments and examples, the advantages of the present disclosure are described as follows.

1. The voltage regulation circuit of the present disclosure monitors at least one power network node and utilizes the control signal corresponding to the at least one load state and the switch of the voltage feedback circuit to apply the feedback voltage to the voltage regulator after switching, thereby dynamically adjusting the node voltage to increase the voltage tolerance range.

2. The voltage regulation circuit of the present disclosure can dynamically configure the node voltages of multiple nodes according to the requirement of each block of the power network (heavy load current or light load current) so as to meet the input voltage specifications of the SoC and avoid the problem of substandard voltage level of the conventional technology.

3. The voltage shifter of the present disclosure can shift the transmitting node voltage and compensate for deterioration of the characteristics of the radio frequency transmitting circuit due to high temperature by increasing the transmitting node voltage.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A voltage regulation circuit, comprising:

a node having a node voltage;

a voltage regulator electrically connected to the node;

a plurality of load units electrically connected to the voltage regulator via the node, wherein the load units are driven by the node voltage and have a plurality of load states;

and a voltage feedback circuit electrically connected between the voltage regulator and the node, wherein the voltage feedback circuit comprises a switch and receives the node voltage and a control signal, and the control signal comprises the load states;

wherein the voltage feedback circuit controls the switch according to the load states of the control signal to output a feedback voltage, and the voltage regulator adjusts the node voltage according to the feedback voltage;

wherein the load units comprise:

a first load unit configured to generate a first load current; and a second load unit configured to generate a second load current;

wherein the load states of the load units are corresponding to the first load current and the second load current, which is one of the load states, the switch is an N-to-1 switch, and N is corresponding to a number of the load states of the load units.

2. The voltage regulation circuit of claim 1, wherein the voltage feedback circuit further comprises:

a voltage divider electrically connected between the switch and the node, wherein the voltage divider receives the node voltage and converts the node voltage to a dividing voltage, and the voltage divider transmits the dividing voltage to the switch;

wherein the switch is switched to output the feedback voltage to be the dividing voltage according to the one load states of the control signal.

3. The voltage regulation circuit of claim 1, wherein, the control signal further comprises a temperature state of a temperature sensor, the temperature sensor is electrically connected to the voltage feedback circuit, the temperature sensor senses an environmental temperature in an environmental space to obtain the temperature state, and the load units are located in the environmental space; and the voltage feedback circuit further comprises:

a voltage shifter electrically connected between the switch and the node, wherein the voltage shifter receives the node voltage and shifts the node voltage to a shifted voltage, and the voltage shifter transmits the shifted voltage to the switch;

wherein the switch is switched to output the feedback voltage to be the shifted voltage according to the load states and the temperature state of the control signal.

4. The voltage regulation circuit of claim 1, wherein, the first load current is one of a first heavy load current and a first light load current;

the second load current is one of a second heavy load current and a second light load current; and N is equal to four, the number of the load states of the load units is equal to four, and the load states of the load units are corresponding to the one of the first heavy load current and the first light load current and the one of the second heavy load current and the second light load current, which is one of the four load states.

5. The voltage regulation circuit of claim 1, wherein the voltage regulator and the voltage feedback circuit are configured to determine at least one target upper limit value and at least one target lower limit value of the node according to the load states of the load units to form at least one target voltage value, the at least one target voltage value is equal to at least one intermediate value between the at least one target upper limit value and the at least one target lower limit value, the feedback voltage is corresponding to the at least one target voltage value, and the voltage regulator adjusts the node voltage toward the at least one target voltage value according to the feedback voltage.

6. The voltage regulation circuit of claim 5, wherein a number of the at least one target upper limit value, a number of the at least one target lower limit value and a number of the at least one target voltage value are all plural, and the switch is switched to output the feedback voltage to be one of the target voltage values according to the load states of the load units.

7. A voltage regulation circuit, comprising:

a node having a node voltage;

a voltage regulator electrically connected to the node;

a plurality of load units electrically connected to the voltage regulator via the node, wherein the load units are driven by the node voltage and have a plurality of load states; and a voltage feedback circuit electrically connected between the voltage regulator and the node, wherein the voltage feedback circuit comprises a switch and receives the node voltage and a control signal, and the control signal comprises the load states;

wherein the voltage feedback circuit controls the switch according to the load states of the control signal to output a feedback voltage, and the voltage regulator adjusts the node voltage according to the feedback voltage;

wherein the load units comprise:

a radio frequency transmitting circuit generating a transmitting current; and a radio frequency receiving circuit generating a receiving current;

wherein the load states of the load units is corresponding to one of the transmitting current and the receiving current, so that the switch is switched to output the feedback voltage according to the one of the transmitting current and the receiving current.

8. A voltage regulation circuit, comprising:

a plurality of nodes having a plurality of node voltages, respectively;

a voltage regulator electrically connected to the nodes;

a plurality of load units electrically connected to the voltage regulator via the nodes, respectively, wherein the load units are driven by the node voltages, respectively, and have at least one load state; and a voltage feedback circuit electrically connected between the voltage regulator and each of the nodes, wherein the voltage feedback circuit comprises a switch and receives the node voltages and a control signal, and the control signal comprises the at least one load state;

wherein the voltage feedback circuit controls the switch according to the at least one load state of the control signal to output a feedback voltage, and the voltage regulator adjusts the node voltage according to the feedback voltage;

wherein the load units comprise:

a radio frequency transmitting circuit generating a transmitting current; and a radio frequency receiving circuit generating a receiving current;

wherein the at least one load state of the load units is corresponding to one of the transmitting current and the receiving current, so that the switch is switched to output the feedback voltage according to the one of the transmitting current and the receiving current, the switch is an N-to-1 switch, and N is corresponding to a number of the at least one load state of the load units.

9. The voltage regulation circuit of claim 8, wherein the voltage feedback circuit further comprises:

a voltage divider electrically connected between the switch and a transmitting node of the nodes, wherein the transmitting node has a transmitting node voltage, the voltage divider receives the transmitting node voltage and converts the transmitting node voltage to a dividing voltage, and the voltage divider transmits the dividing voltage to the switch;

wherein the switch is switched to output the feedback voltage to be the dividing voltage according to the at least one load state of the control signal.

10. The voltage regulation circuit of claim 8, wherein, the control signal further comprises a temperature state of a temperature sensor, the temperature sensor is electrically connected to the voltage feedback circuit, the temperature sensor senses an environmental temperature in an environmental space to obtain the temperature state, and the load units are located in the environmental space; and the voltage feedback circuit further comprises:

a voltage shifter electrically connected between the switch and a transmitting node of the nodes, wherein the transmitting node has a transmitting node voltage, the voltage shifter receives the transmitting node voltage and shifts the transmitting node voltage to a shifted voltage, and the voltage shifter transmits the shifted voltage to the switch;

wherein the switch is switched to output the feedback voltage to be the shifted voltage according to the at least one load state and the temperature state of the control signal.

11. The voltage regulation circuit of claim 8, wherein the nodes comprise:

a transmitting node connected to the radio frequency transmitting circuit and having a transmitting node voltage; and a receiving node connected to the radio frequency receiving circuit and having a receiving node voltage;

wherein the switch is switched to output the feedback voltage to be one of the transmitting node voltage and the receiving node voltage according to the one of the transmitting current and the receiving current.

12. The voltage regulation circuit of claim 11, wherein, in response to determining that the radio frequency transmitting circuit is turned on and the radio frequency receiving circuit is turned off, the switch is switched to output the feedback voltage to be the transmitting node voltage according to the transmitting current; and in response to determining that the radio frequency receiving circuit is turned on and the radio frequency transmitting circuit is turned off, the switch is switched to output the feedback voltage to be the receiving node voltage according to the receiving current.

* * * * *